United States Patent [19]

Matsumoto et al.

[11] Patent Number: 5,069,192

[45] Date of Patent: Dec. 3, 1991

[54] INTERNAL COMBUSTION ENGINE WITH CRANKCASE VENTILATION SYSTEM

[75] Inventors: Eiichi Matsumoto, Yokohama City; Tatsuo Aruga, Kawasaki City, both of Japan

[73] Assignee: Nissan Motor Company, Ltd., Yokohama City, Japan

[21] Appl. No.: 599,964

[22] Filed: Oct. 19, 1990

[30] Foreign Application Priority Data

Oct. 24, 1989 [JP] Japan ..... 1-124244[U]
Oct. 24, 1989 [JP] Japan ..... 1-124246[U]

[51] Int. Cl.[5] ..... F02M 25/00
[52] U.S. Cl. ..... 123/572; 123/41.86
[58] Field of Search ..... 123/41.86, 572, 574, 123/196 CP, 198 P

[56] References Cited

U.S. PATENT DOCUMENTS 4,958,613 9/1990 Hiraoka et al. ..... 123/572

*Primary Examiner*—Noah P. Kamen

*Attorney, Agent, or Firm*—Pennie & Edmonds

[57] ABSTRACT

An internal combustion engine having a crankcase ventilation system is shown. The engine comprises a cylinder block and an oil pan which are assembled to define a crankcase. A crankshaft is rotatably held in the crankcase and including a counterweight. The cylinder block is formed with a fresh air inlet passage through which the interior of the crankcase and the outside of the engine are communicated. The fresh air inlet passage has a fresh air inlet opening which is exposed to the interior of the crankcase at a position close to the counterweight so that under rotation of the crankshaft, the opening is periodically covered and opened by the counterweight. A blow-by gas passage is provided through which the interior of the crankcase and the outside of the engine are communicated. The opening of the fresh air inlet passage is covered by the counterweight when the passage in the crankcase becomes relatively high, and opened by the same when the pressure in the crankcase becomes relatively low.

29 Claims, 13 Drawing Sheets

INTERNAL COMBUSTION ENGINE WITH CRANKCASE VENTILATION SYSTEM

BACKGROUND OF THE INVENTION

1. Field of the Invention

The present invention relates in general to an internal combustion engine having a crankcase ventilation system, and more particularly, to the crankcase ventilation system which discharges blow-by gas from the crankcase by enforcedly introducing fresh air thereinto.

2. Description of the Prior Art

Hitherto, in the field of internal combustion engines, various types of crankcase ventilation systems have been proposed and put into practical use.

Widely used is a type in which fresh air is introduced from an air intake passage upstream of the throttle valve into a crankcase of the engine through an oil separator defined in a cylinder head cover, and blow-by gas in the crankcase, which is thus driven by the fresh air, is introduced into the air intake passage downstream of the throttle valve through another oil separator defined in the cylinder head cover.

This type ventilation system is disclosed in, for example, Japanese Patent First Provisional Publication 58-143109. In this disclosed system, two conduits are provided respectively at front and rear portions of the crankcase, each communicating the interior of the crankcase with that of the cylinder head cover. Qne conduit is used for the fresh air and the other for the blow-by gas.

However, due to its inherent construction, the ventilation system of this commonly used type has failed to exhibit a satisfied ventilation performance. This is because the power used for driving the blow-by gas is produced by only the pressure difference between the upstream and downstream portions of the air intake passage. Particularly, in the system of the publication, the ventilation effect is very poor because the cylinder head cover used is constructed to constitute therewithin a so-called "bypass conduit" which bypasses the crankcase. In this arrangement, the blow-by gas driving power is not effectively applied to the crankcase.

SUMMARY OF THE INVENTION

It is therefore an object of the present invention to provide an internal combustion engine having a crankcase ventilation system which exhibits a satisfactory ventilation performance.

According to the present invention, there is provided an internal combustion engine which comprises a cylinder block and an oil pan which are assembled together to define a crankcase, a crankshaft rotatably held in the crankcase and including a counterweight, means defining a fresh air passage through which the interior of the crankcase and the outside of the engine are communicated, the fresh air passage having a fresh air inlet opening exposed to the interior of the crankcase at a position close to said counterweight so that, under rotation of the crankshaft, the fresh air inlet opening is periodically covered by the counterweight, means for defining a blow-by gas passage through which the interior of the crankcase and the outside of the engine are communicated; and means for producing in the crankcase a pressure fluctuation during operation of the engine, wherein the fresh air inlet opening is covered by the counterweight when the pressure in the crankcase is relatively high.

BRIEF DESCRIPTION OF THE DRAWING

Other objects and advantages of the present invention will become apparent from the following description when taken in conjunction with the accompanying drawings, in which.

DETAILED DESCRIPTION OF THE INVENTION

Figure 1:
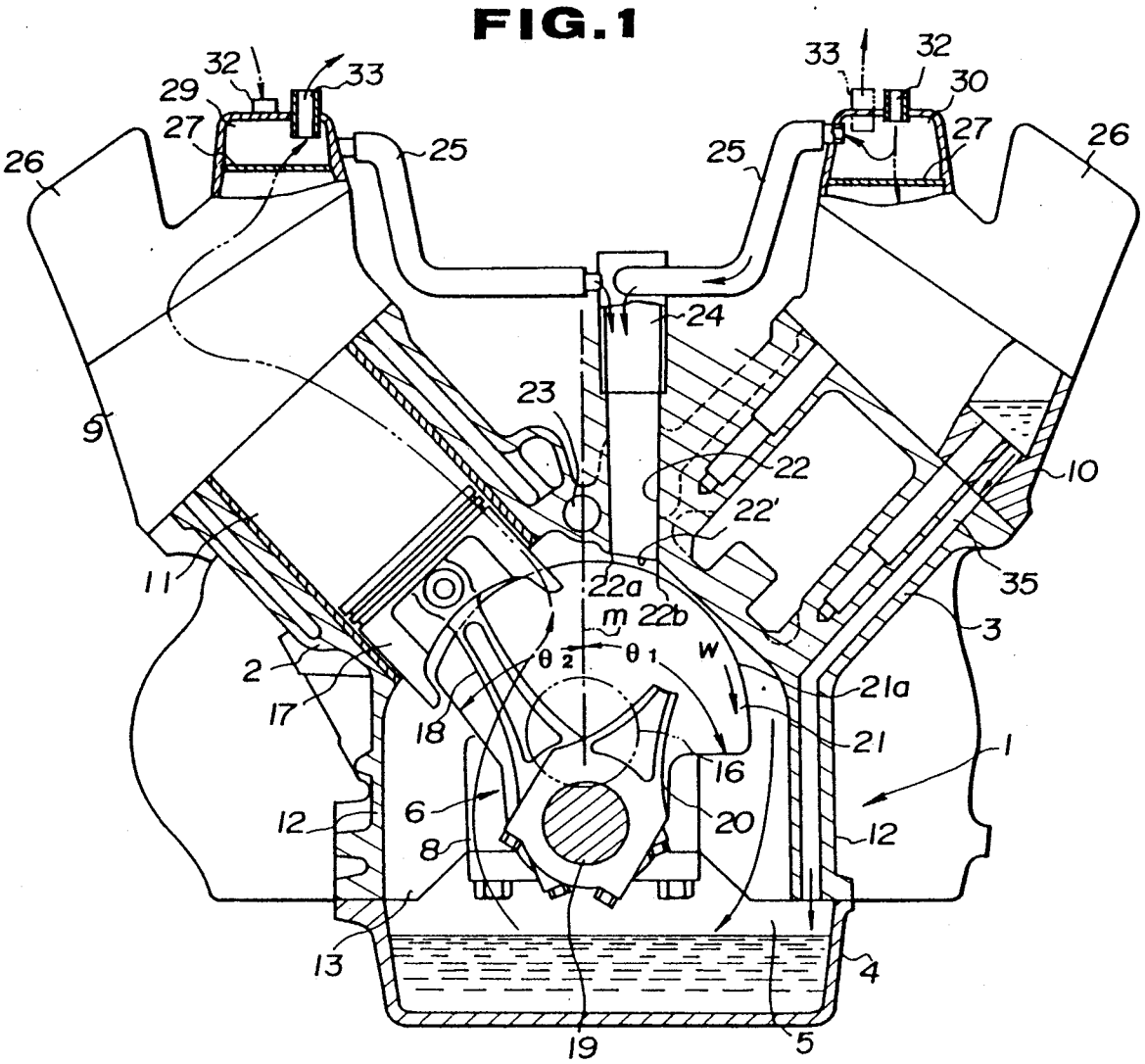
FIG. 1 is a laterally sectional view of a V-8 type internal combustion engine having a crankcase ventilation system of a first embodiment of the present invention.
Figure 2:
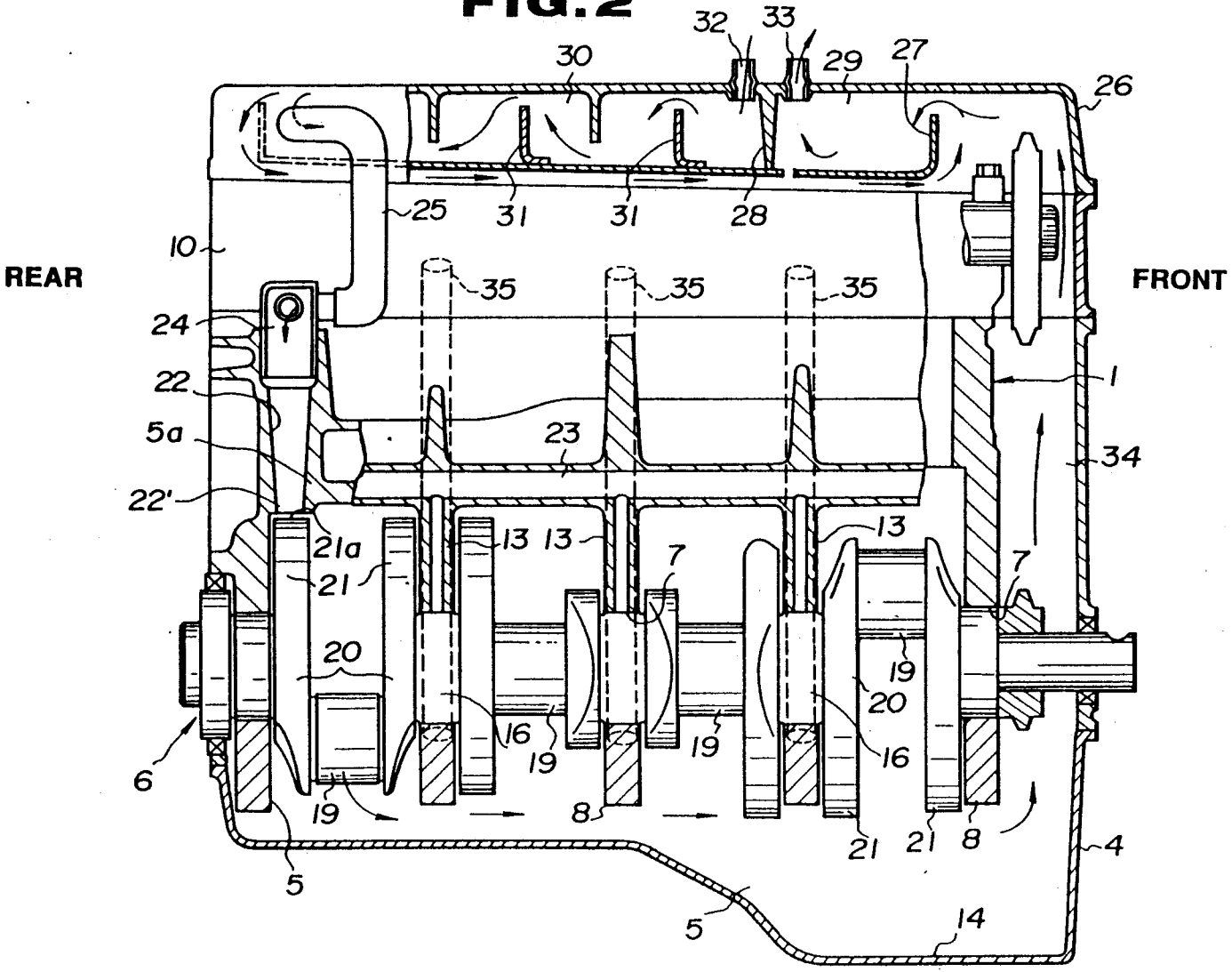
FIG. 2 is a longitudinally sectional view of the engine of FIG. 1.
Figure 3:
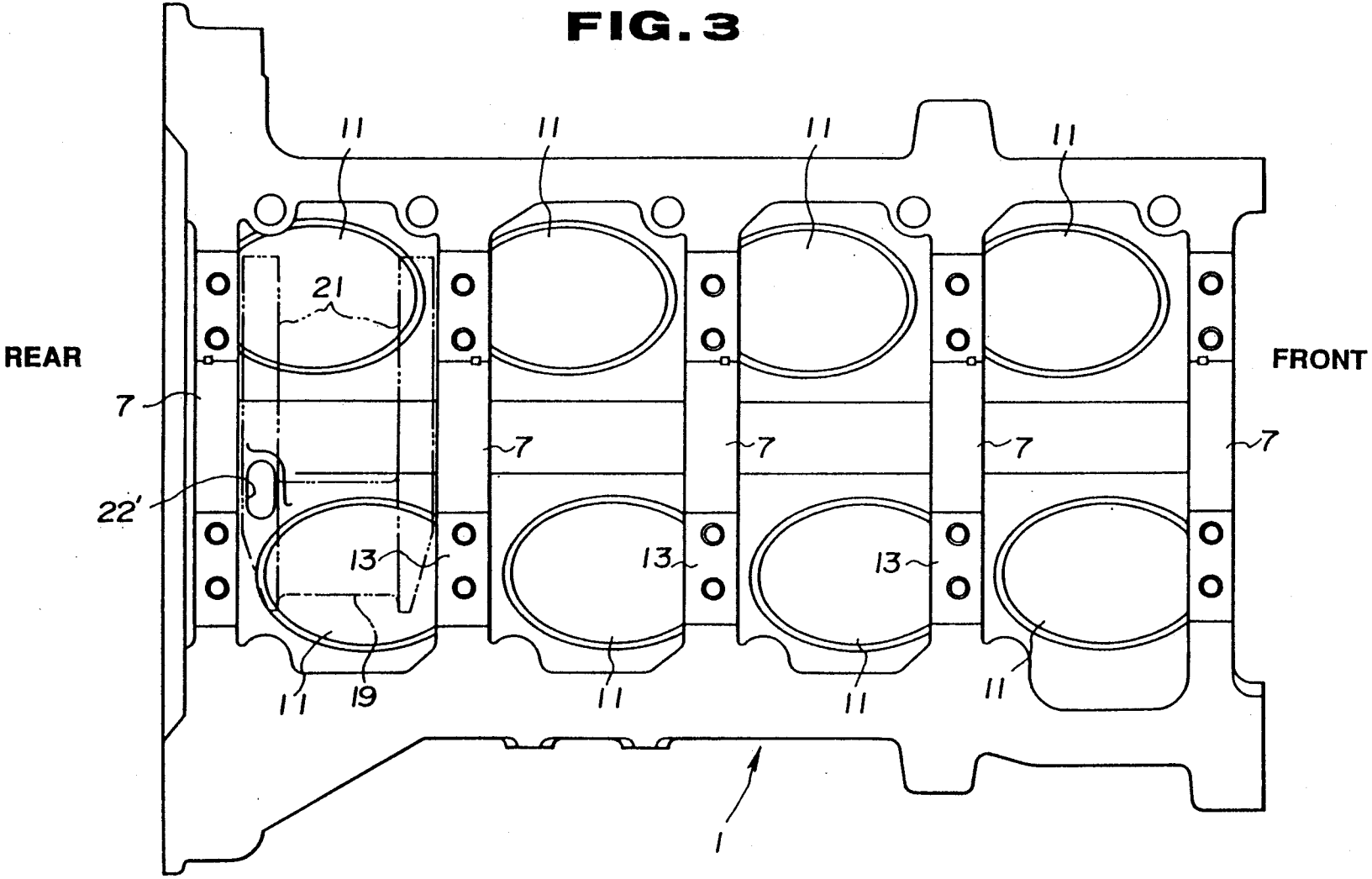
FIG. 3 is a bottom view of a cylinder block of the engine of FIG. 1.

Referring to FIGS. 1 to 3 of the accompanying drawings, there is shown a first embodiment of the present invention, which is a crankcase ventilation system practically applied to a V-8 type four cycle internal combustion engine.

In the drawings, denoted by numeral 1 is a cylinder block which is formed with two angled banks 2 and 3. The cylinder block 1 has an oil pan 4 which is secured to the bottom of the cylinder block 1. With this, a so-called crankcase 5 is defined by the cylinder block 1 and the oil pan 4, as shown. Denoted by numeral 6 is a crankshaft which is rotatably held by bearing portions 7 of the cylinder block 1 through bearing caps 8. Denoted by numerals 9 and 10 are respective cylinder heads which are disposed on the banks 2 and 3 of the cylinder block, 1.

The cylinder block 1 is a one piece structure of cast iron or the like, which has four cylinder bores 11 in each bank 2 or 3. The cylinder block 1 is formed at its lower sides with a skirt portion 12 which is of the deep skirt type. Within the skirt portion 12, there are formed a plurality of bulkheads 13 by which the interior of the crankcase 5 is divided into four aligned compartments. (The aligned compartments will be understood from FIG. 14) The above-mentioned bearing portions 7 are defined by the bulkheads 13 respectively.

As is seen from FIG. 1, the oil pan 4 is secured to a lower edge of the skirt portion 12.

As is seen from FIG. 2, the oil pan 4 is formed at its front portion, that is, the portion near the #1 and #2 cylinders, with a considerable recess 14 which serves as an oil sump.

The crankshaft 6 comprises generally five coaxially aligned journal portions 16 which are respectively held by the bearing portions 7, four crank pins 19 which are pivotally connected to respective pistons 17 through respective connecting rods 18, crank arms 20 which connect the crank pins 19 with the journal portions 16 and counterweights 21 which are integral with the crank arms 20.

As is seen from FIG. 2, the four crank pins 19 are spaced 90 degree apart from one another. Each crank pin 19 has paired connecting rods 18 (viz., the respective connecting rods from the two banks 2 and 3) pivotally connected thereto. That is, the pistons 17 in the cylinders #1 and #2 are connected to the first, viz., frontmost, crank pin 19, the pistons 17 in the cylinders #3 and #4 are connected to the second crank pin 19, the pistons 17 in the cylinders #5 and #6 are connected to the third crank pin 19 and the pistons 17 in the cylinders #7 and #8 are connected to the fourth, viz., rearmost, crank pin 19.

Figure 12:
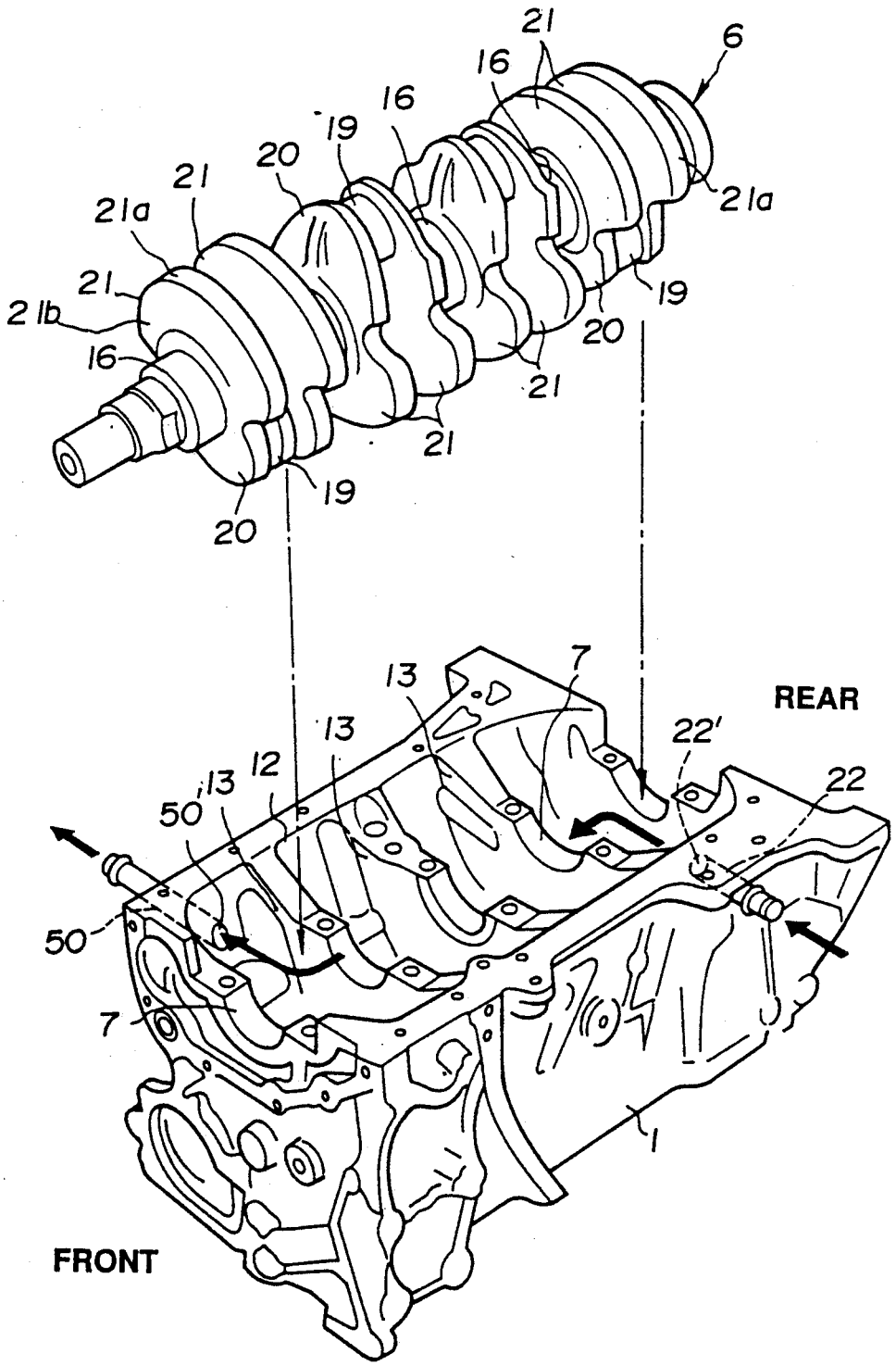
FIG. 12 is a perspective view of a cylinder head and a crankshaft which are employed in the fifth embodiment and which are illustrated upside down for clarification.

Each counter weight 21 is integrally formed on the crank arm 20 at a diametrically opposed portion of the corresponding crank pin 19, as may be understood from FIG. 12. As is seen from FIG. 1, the counterweight 21 has a sectoral configuration whose arcuate outer surface 21*a* is concentric with the axis of the crankshaft 6 and extends by about 140 to 150 degrees with respect to said axis. It is to be noted that the engine shown in FIG. 1 is so arranged that under operation of the engine, the crankshaft 6 rotates in a clockwise direction, that is, the direction denoted by the arrow "ω". It is also to be noted that the sectional view of FIG. 1 is viewed from the front of the engine, that is, a position near the cylinders #1 and #2.

As is best seen from FIG. 2, the cylinder block 1 is formed at a rear upper wall 5*a* of the crankcase 5, more specifically, at a rear generally middle joint portion of the two banks 2 and 3, with a fresh air intake passage 22. The passage 22 has an opening 22' which is exposed to the rearmost compartment in which the rearmost counterweight 21 is received.

In fact, as is seen from FIGS. 3 and 2, the position of the passage 22 is somewhat offset in the direction of rotation of the crankshaft 6 with respect to the rotation axis of the crankcase 5 in order to avoid interference with an oil gallery 23.

As is seen from FIG. 2, the opening 22' is so positioned as to face the arcuate outer surface 21*a* of the rearmost counterweight 21 when the latter is turned into a given angular zone. That is, when the rearmost counterweight 21 is turned into the given angular zone which is near the opening 22' of the passage 22, there is produced only a very thin clearance between the opening 22' of the passage 22 and the arcuate outer surface 21*a* of the counterweight 21. Preferably, the clearance is about 3 to 4 mm in thickness.

As is seen from FIG. 3, the opening 22' of the passage 22 is elongated in the direction perpendicular to the rotation axis of the crankshaft 6. Furthermore, the width of the opening 22' is somewhat smaller than the thickness of the counterweight 21.

Figure 4:
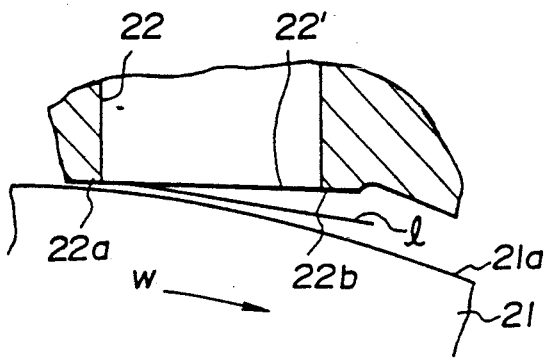
FIG. 4 is an enlarged sectional view of a fresh air inlet part of the ventilation system.

As is seen from FIG. 4, the opening 22' of the fresh air inlet passage 22 is somewhat inclined with respect to the arcuate outer surface 21*a* of the rearmost counterweight 21. That is, the clearance defined between a leading end 22*a* of the opening 22' and the arcuate outer surface 21*a* of the counterweight 21 is smaller than that between a trailing end 22*b* of the opening 22' and the arcuate outer surface 21*a*. In other words, the clearance between the opening 22' and the arcuate outer surface 21*a* increases gradually with increase of distance from the leading end 22*a* toward the trailing end 22*b*. This will be understood from a tangent line "l" which extends downwardly from the leading end 22*a* of the opening 22'.

Accordingly, during rotation of the counterweight 21, oil drops are splashed downward by the counterweight 21 are prevented or at least obstructed from entering the fresh air inlet passage 22. Furthermore, due to the unique form of the clearance, the dynamic pressure inevitably created by a leading end of the arcuate outer surface 21*a* of the counterweight 21 does not have a substantial effect on the opening 22'. Thus, undesirable back flow of the fresh air in the passage 22 is suppressed.

Figure 5:
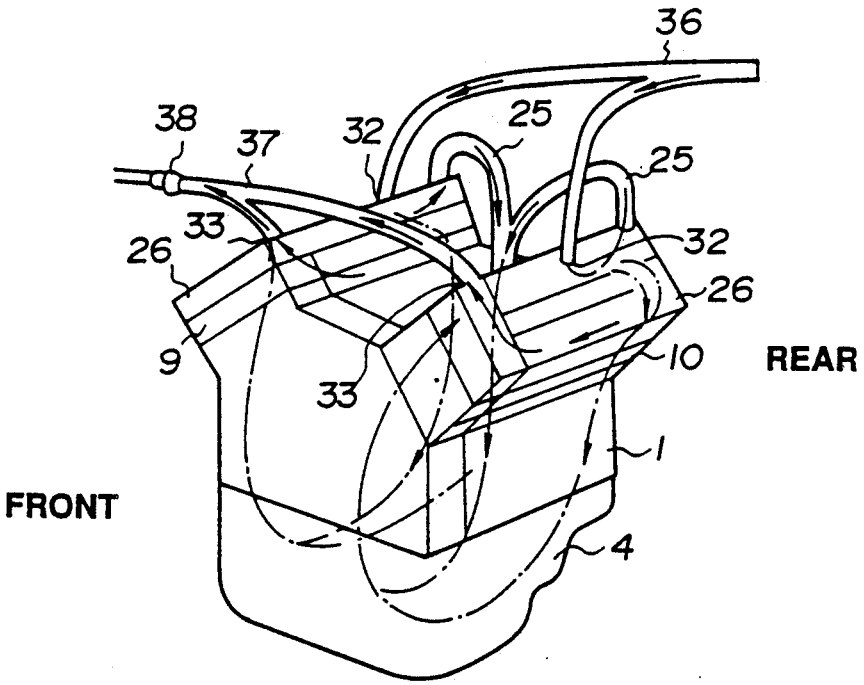
FIG. 5 is a perspective view of the engine, showing a layout of piping arrangement employed in the ventilation system.

As is seen from FIGS. 1, 2 and 5, the fresh air passage 22 is connected through a connector 24 and a pair of connecting tubes 25 to respective cylinder head covers 26.

As is seen from FIG. 2, within each cylinder head cover 26, there are arranged second and first oil separators 29 and 30 which are defined by a baffle plate 27 and a partition wall 28 integral with the head cover 26. That is, these second and first oil separators 29 and 30 are located at front and rear portions of the cover 26 and partitioned by the partition wall 28. Within the first oil separator 30, there are arranged baffle walls 30 to form a so-called "labyrinth". A fresh air inlet pipe 32 is connected to a front end portion of the first oil separator 30 to flow fresh air in the same in the direction depicted by the arrows. Each connecting tube 25 from the connector 24 is led to a rear end portion of the first oil separator 30. The second oil separator 29 is equipped at its rear end portion with a blow-by gas outlet pipe 33. The second oil separator 29 has at its front end a clearance which is exposed to an upper portion of a chain chamber 34 of the engine. During operation of the engine, blow-by gas is forced flow in the second oil separator 29 in the direction depicted by the arrows for the reasons which will be described hereinafter.

The chain chamber 34 houses a cam chain (not shown) of a known valve operating mechanism. The chain chamber 34 is defined by the cylinder block 1 and the two cylinder heads 9 and 10. This means that the interior of each cylinder head cover 26 is communicated with a front portion of the interior of the crankcase 5 through the chain chamber 34. The blow-by gas in the crankcase 5 is forced to flow toward the second oil separator 29 through the chain camber 34.

It is to be noted that numerals 35 in FIGS. 1 and 2 denote oil return passages which function to return oil from an upper surface of each cylinder head 9 or 10 to the crankcase 5. As will be understood from FIG. 1, when the upper surface of the cylinder head 9 or 10 collects no oil, the oil return passages 35 function as blow-by gas flowing passages.

As will be understood from FIG. 5, the fresh air inlet pipe 32 of each cylinder head cover 26 is connected through a connecting tube 36 to an air intake passage (not shown) at a position upstream of a throttle valve (not shown). The blow-by gas outlet pipe 33 of each cover 26 is connected through another connecting tube 37 to the air intake passage at a position downstream of the throttle valve. The connecting tube 37 is equipped with a PCV (Positive Crankcase Ventilation) valve 38 in order to regulate the flow of return blow-by gas in accordance with intake manifold vacuum.

In the following, the operation of an embodiment of the present invention will be described.

During operation of the engine, the four aligned compartments of the crankcase 5, which are defined by the bulkheads 13, are subjected to a considerable pressure fluctuation due to the reciprocating movements of the corresponding pistons 17.

Due to the inherent construction of the engine, the fresh air inlet passage 22 is affected mainly by the pressure fluctuation in the rearmost compartment which is associated with the cylinders #7 and #8.

That is, as is seen from FIG. 1, the compartment associated with the cylinders #7 and #8 shows a minimum volume (higher pressure) when the corresponding crank pin 19 assumes its lowermost position and a maximum volume (lower pressure) when the pin 19 assumes its uppermost position. When the crank pin 19 assumes the lowermost or uppermost position, the axis of the pin 19 lies on an imaginary bisector line "m" of the angle between the two banks 2 and 3. Accordingly, the volume of the compartment varies in a manner as is depicted by the curve "a" in the graph of FIG. 6.

Figure 6:
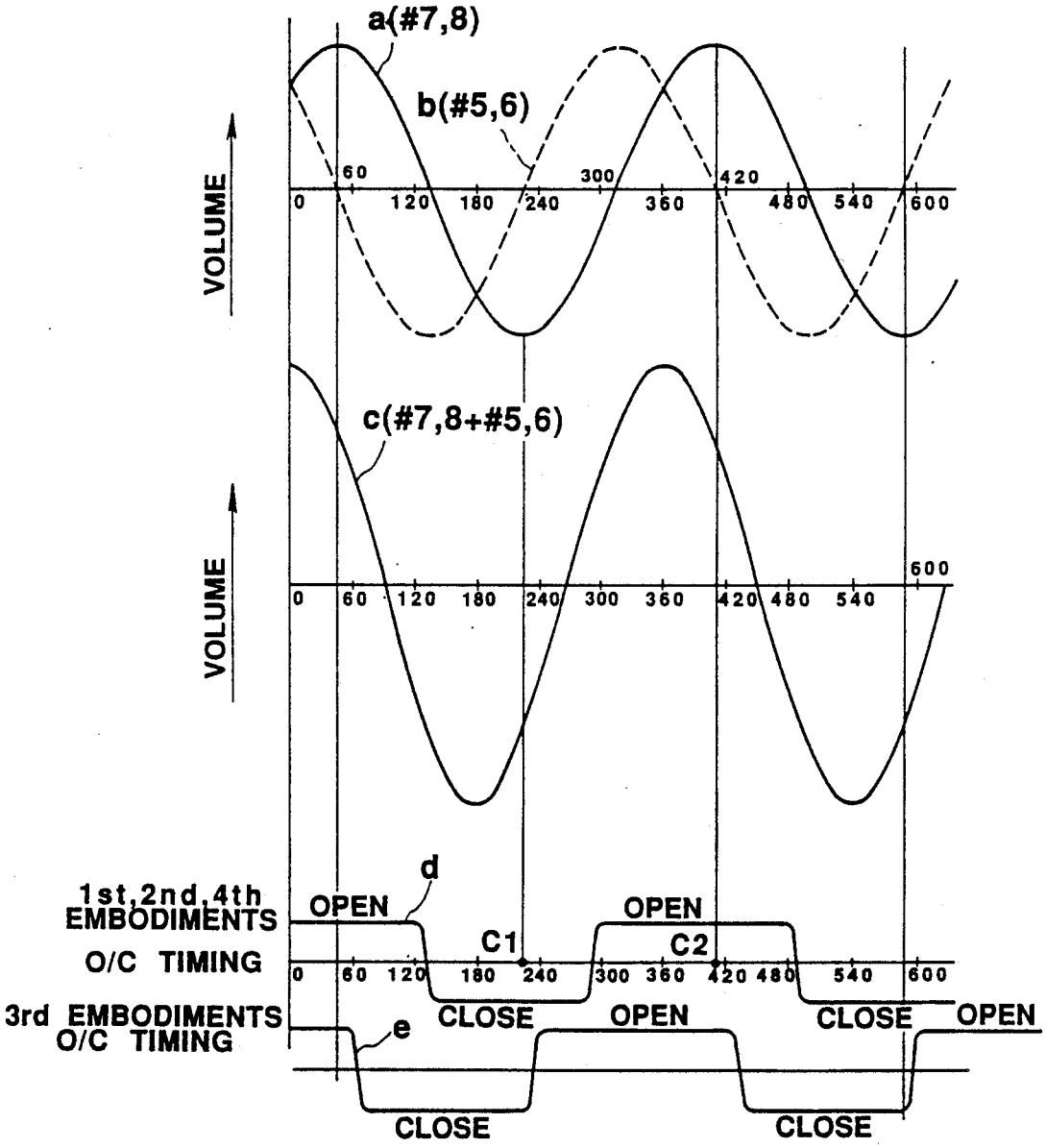
FIG. 6 is a graph of characteristic curves, showing a relationship between a volume change of each compartment of the crankcase and an opening and closing timing of the fresh air inlet.

While, during operation of the engine, the opening 22' of the fresh air inlet passage 22 is periodically opened and closed (more specifically, spacedly covered) by the arcuate outer surface 21*a* of the counterweight 21 in a manner as is depicted by the line "d" in the graph of FIG. 6. As is understood from the line "d" and the curve "a" of the graph, for a certain period which includes the time (viz., the time corresponding to C1 in crankangle) when the compartment shows the minimum volume (viz., maximum pressure), the opening 22' is closed (or spacedly covered) by the counterweight 21, while, for a certain period which includes the time (viz., the time corresponding to C2 in crankangle) when the compartment shows the maximum volume (viz., minimum pressure), the opening 22' is opened.

Accordingly, at the opening 22', a pumping effect is created using the counterweight 21 as a valve means, so that the fresh air in the fresh air passage 22 is forceful driven into the crankcase 5. Although the volume reducing operation of the compartment (that is, compartment compression stroke) begins prior to the opening closing operation of the counterweight 21 (see FIG. 6), undesired back flow of the fresh air is prevented because. In there is a considerable difference in time between the time when the volume reducing operation starts and the time when a pressure change caused by the volume reducing operation appears at the opening 22' of the passage 22.

In addition, a pressure fluctuation in the adjacent compartment associated with the cylinders #5 and #6 has an effect, but small, on the flow of fresh air in the fresh air inlet passage 22. In specific, the volume of the adjacent compartment varies in a manner as is depicted by the curve "b" in the graph of FIG. 6. It is to be noted that the curve "b" is advanced by 90 degrees in phase with respect to the curve "a". Thus, the entire volume of the two compartments varies in a manner as is depicted by the curve "c". It is to be noted that the curve "c" shows the volume reducing operation which takes place somewhat earlier than that of the curve "a". Thus, the timing of closing the opening 22' by the counterweight 21 is set somewhat earlier than that determined by only the curve "a".

As is shown in FIG. 1, in order to achieve this earlier closing timing, the counterweight 21 for the cylinders #7 and #8 has an asymmetric structure. That is, under the illustrated condition of the counterweight 21, the angle "$\theta 1$" defined between the leading edge of the counterweight 21 and the imaginary bisector line "m" is somewhat greater than the angle "$\theta 2$" defined between the trailing edge of the weight 21 and the line "m".

As is understood from the above description, during operation of the engine, the fresh air in the fresh air inlet passage 22 is enforcefully driven into the crankcase 5 due to the pumping effect generated at the opening 22'. Accordingly, blow-by gas in the crankcase 5 is effectively driven into the second oil separator 29 in the cylinder head covers 26 through the chain chamber 34 and the oil return passages 35 and finally the blow-by gas is fed to the air intake passage through the connecting tube 37.

Accordingly, even when there is only a small pressure difference between the upstream and downstream portions of the air intake passage of the engine, the interior of the crankcase 5 can be effectively ventilated or scavenged.

Figure 7:
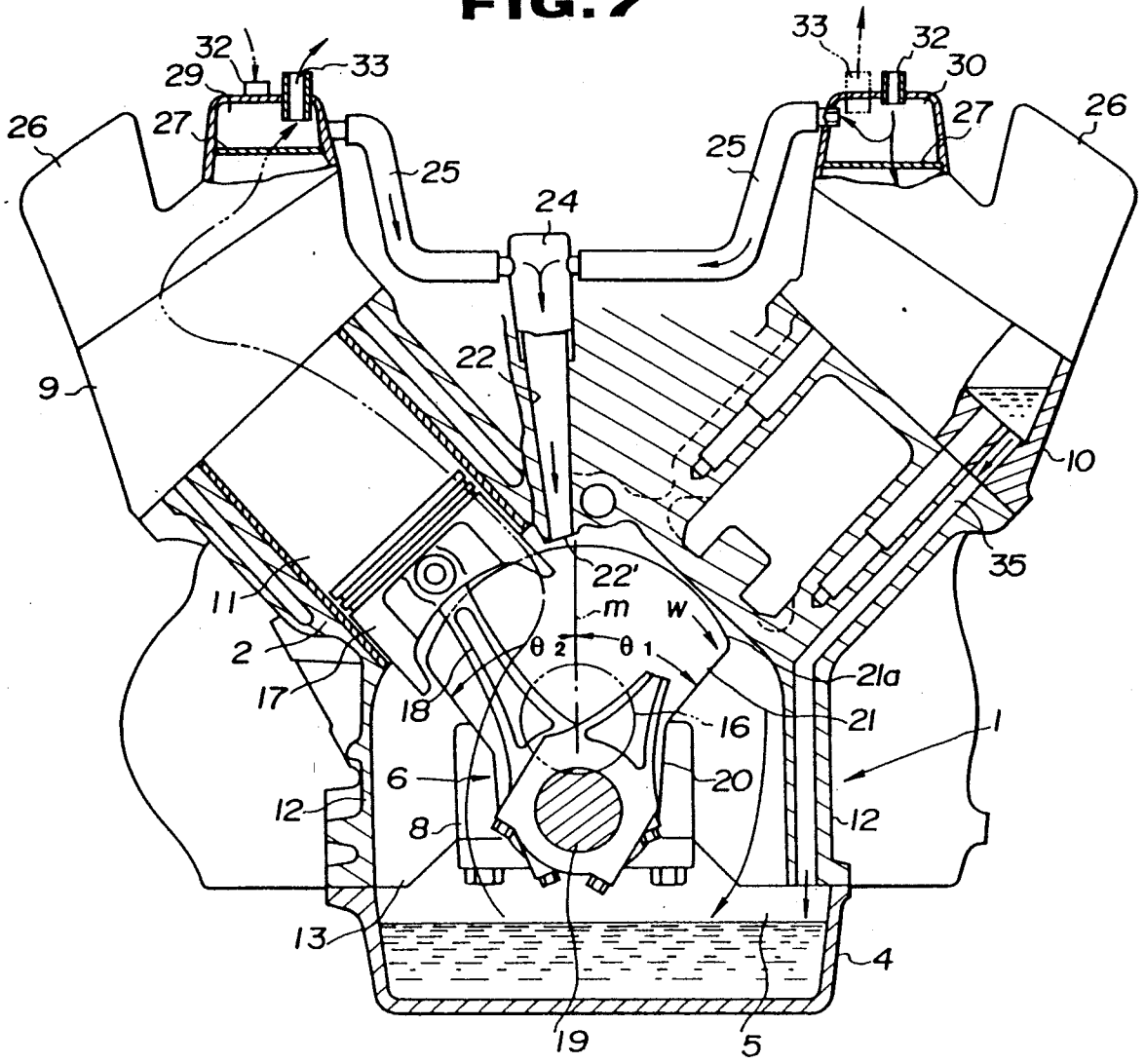
FIG. 7 is a view similar to FIG. 1, but showing a second embodiment of the present invention.

Referring to FIG. 7, there is shown a second embodiment of the present invention. The parts and constructions identical to those of the above-mentioned first embodiment are denoted by the same numerals.

As will be seen from the drawing, in the second embodiment, the fresh air inlet passage 22 is positioned nearer the bank 2 than the other bank 3. That is, the passage 22 is somewhat displaced in a direction opposite to the rotation direction "$\omega$" of the crankshaft 6, with respect to the passage 22 of the first embodiment. In this second embodiment, the rearmost counterweight 21 has such a structure in which the angle "$\theta 1$" is equal to the angle "$\theta 2$". The opening and closing operation of the opening 22' of the passage 22 is carried out like in the first embodiment, that is, in a manner as is depicted by the line "d" of the graph of FIG. 6.

Figure 8:
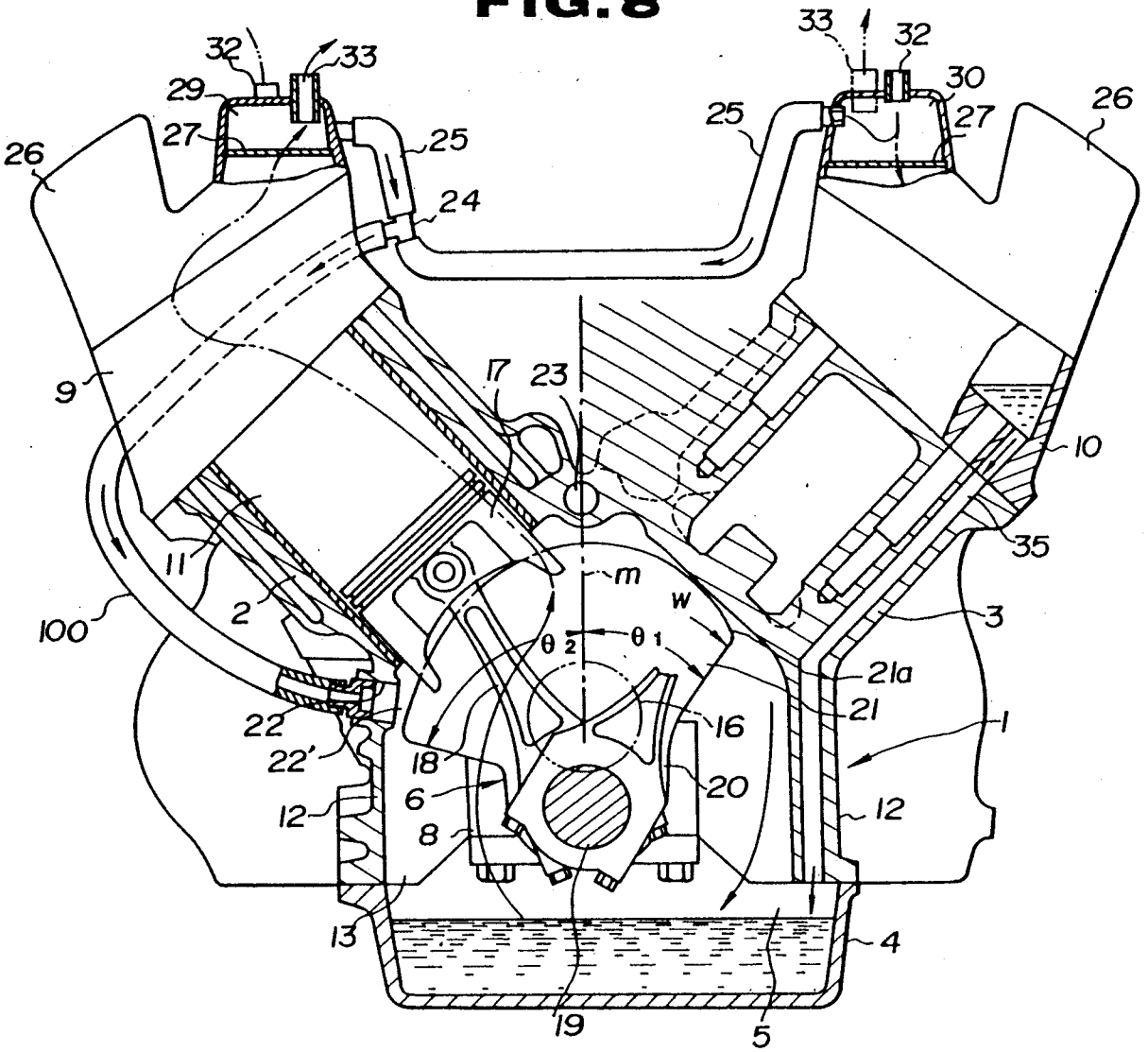
FIG. 8 is a view similar to FIG. 1, but showing a third embodiment of the present invention.

Referring to FIG. 8, there is shown a third embodiment of the present invention.

In this embodiment, the fresh air inlet passage 22 is formed in one side wall of the cylinder block 1 at a position below the bank 2 and connected to the paired connecting tubes 25 through a connecting tube 100 and the connector 24. The rearmost counterweight 21 is shaped to have an asymmetric structure, that is, $\theta 2 > \theta 1$. Thus, the opening and closing operation of the passage 22 is carried out somewhat earlier than that in the first and second embodiments, that is, in a manner as is depicted by the line "e" of the graph of FIG. 6.

Figure 9:
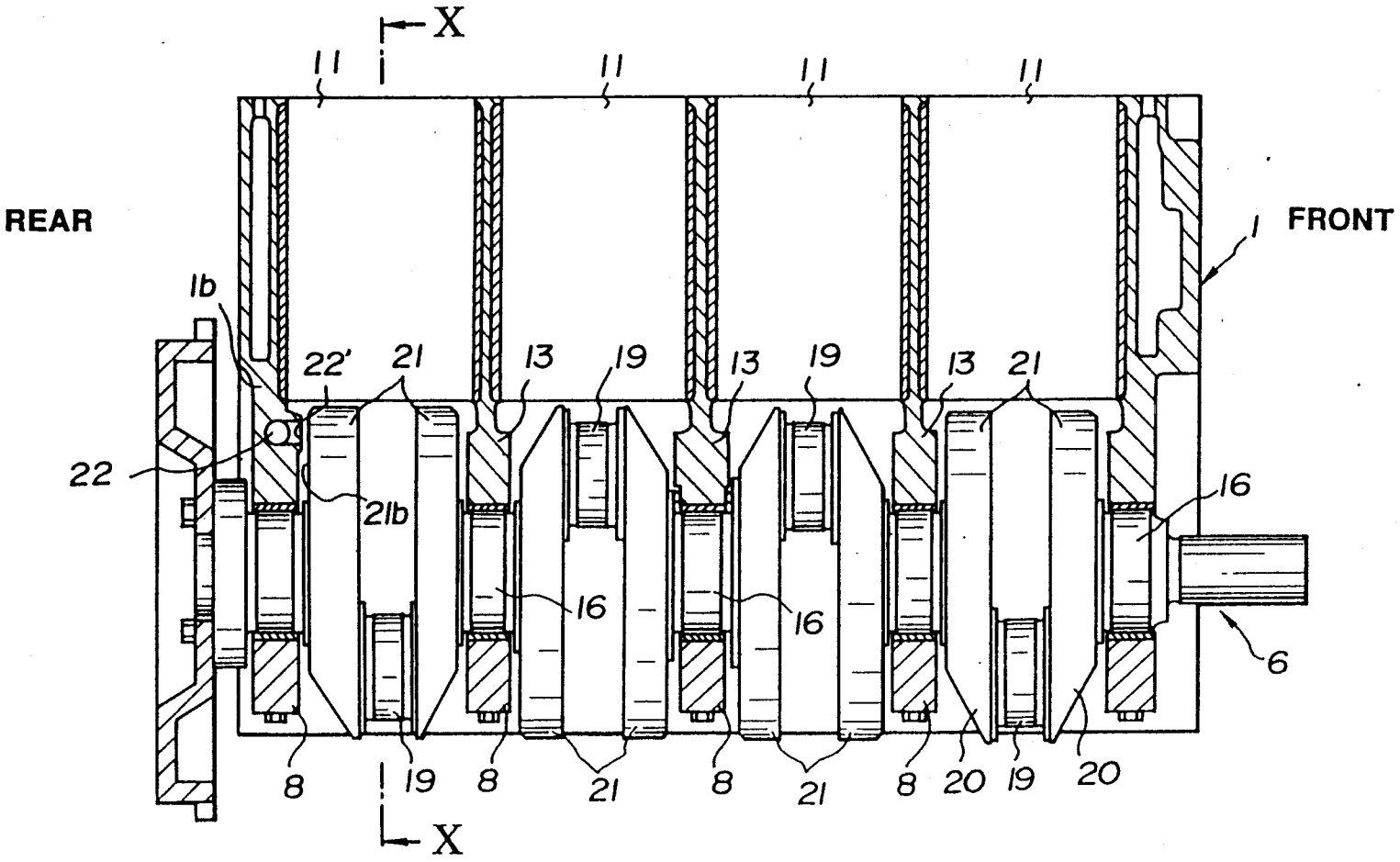
FIG. 9 is a longitudinally sectional view of an in-line internal combustion engine having a crankcase ventilation system of a fourth embodiment of the present invention.
Figure 10:
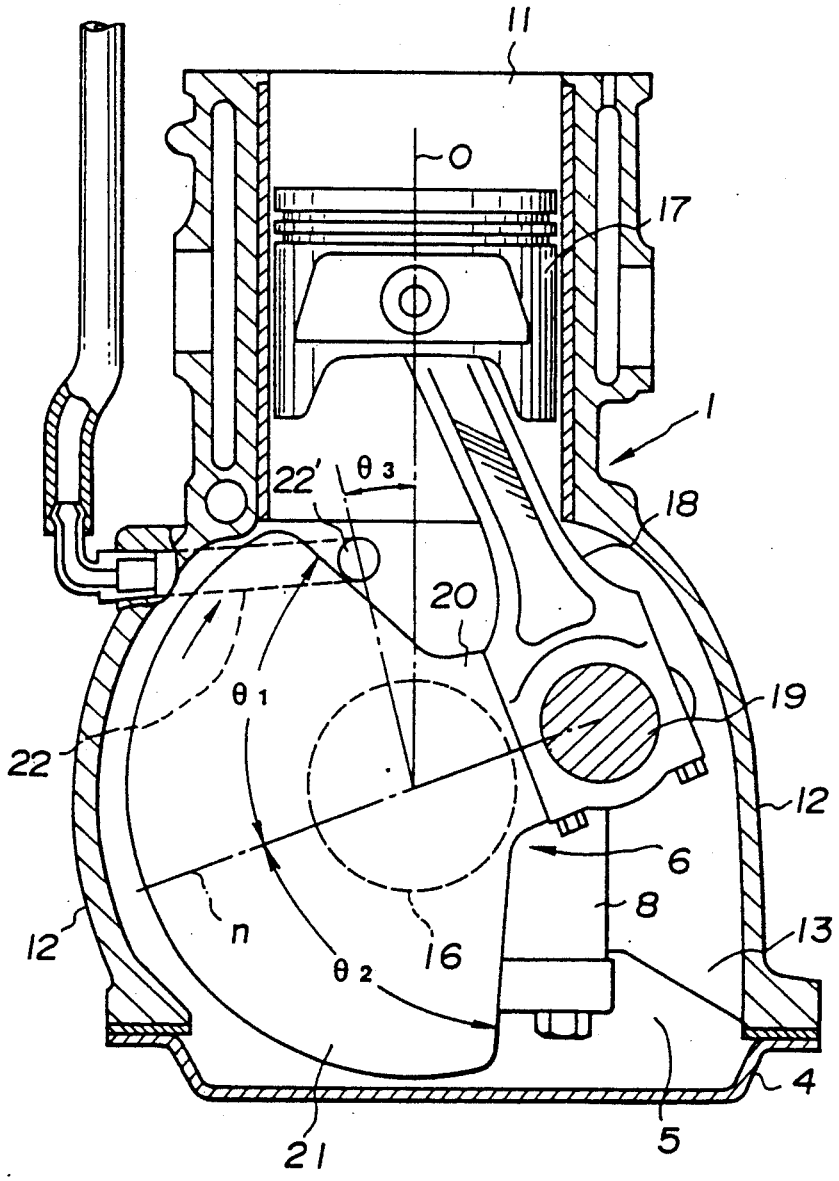
FIG. 10 is a sectional view taken along the line X—X of FIG. 9.

Referring to FIGS. 9 and 10, there is shown a fourth embodiment of the present invention, which is applied to an in-line four cylinder type engine.

In this fourth embodiment, the cylinder block 1 is formed at its rear end wall 1*b* with a fresh air inlet passage 22. The passage 22 has an opening 22' which is exposed to the compartment in which the rearmost counterweight 21 is located. More specifically, as is understood from FIG. 10, the opening 22' is so positioned as to face a major outer surface 21*b* of the counterweight 21 when the weight 21 is turned to a zone wherein the counterweight 21 covers or conceals the opening 22'. In this embodiment, the rearmost counterweight 21 is shaped symmetric with respect to an imaginary line "n" which passes through both the rotation axis of the crankshaft 6 and the axis of the associated crank pin 19. In other words, the angle "$\theta 1$" is equal to the angle "$\theta 2$".

Furthermore, as is seen from FIG. 10, the opening 22' of the passage 22 is positioned somewhat upstream of an imaginary line "o" with respect to the rotation direction of the crankshaft 6, the line "o" being the center axis of the cylinder bore 11. Denoted by "$\theta 3$" is the angle defined between the center of the opening 22' and the line "o".

Thus, the opening and closing operation of the opening 22' is carried out in a manner as is depicted by the line "d" of graph of FIG. 6, which is similar to the cases of the first and second embodiments.

Figure 11:
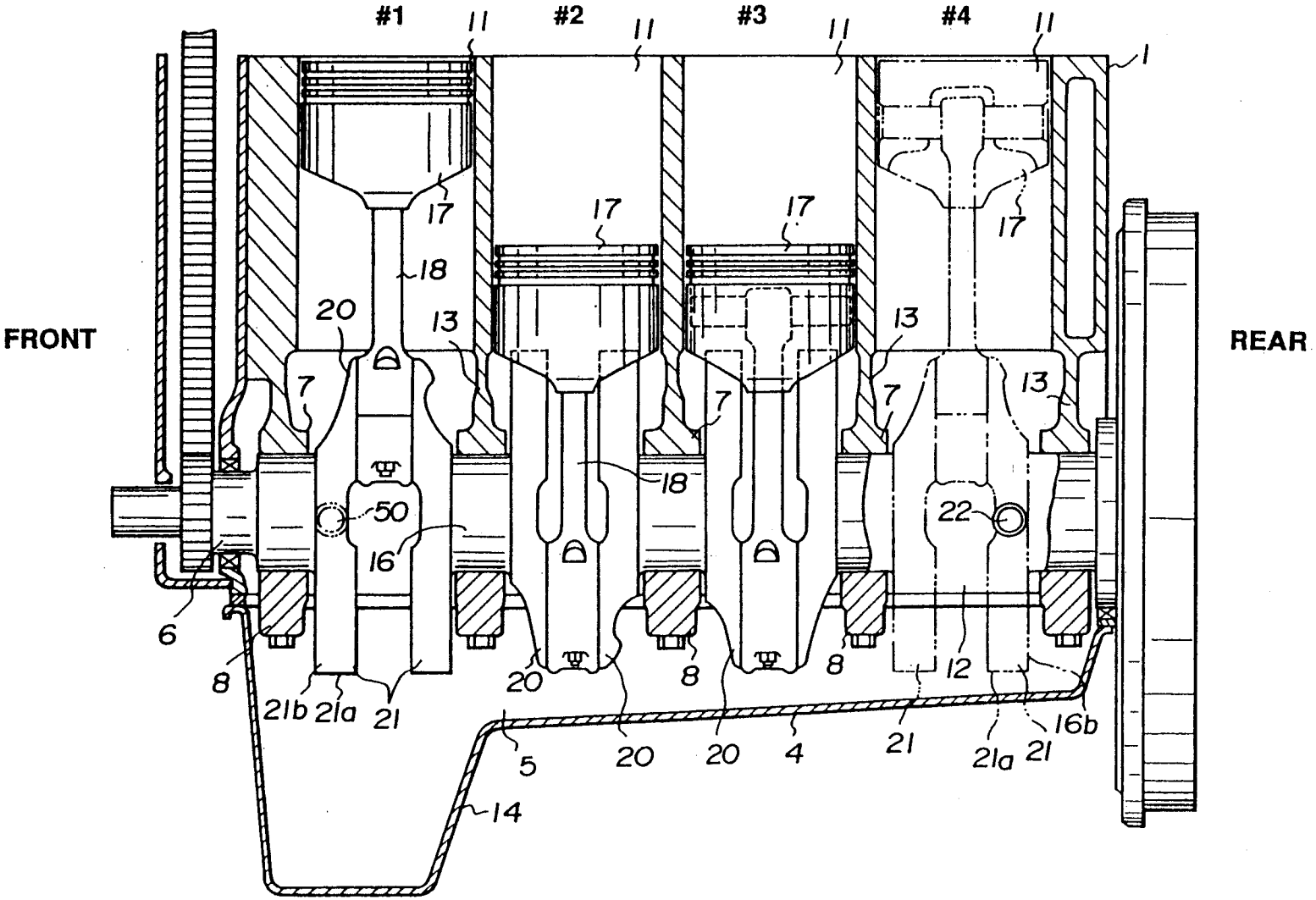
FIG. 11 is a view similar to FIG. 9, but showing a fifth embodiment of the present invention.

Referring to FIGS. 11 and 12, there is shown a fifth embodiment of the present invention, which is applied to an in-line four cylinder type internal combustion engine.

In the drawings, denoted by numeral 1 is a cylinder block. An oil pan 4 is secured to the bottom of the cylinder block 1 to define therebetween a so-called crankcase 5. Denoted by numeral 6 is a crankshaft which is rotatably held by bearing portions 7 of the cylinder head 1 through bearing caps 8.

The cylinder block 1 is of one piece structure of cast iron or the like, which has four cylinder bores 11 (viz., #1, #2, #3 and #4). The cylinder block 1 is formed at its lower sides with a skirt portion 12 which is of the deep skirt type. Within the skirt portion 12, there are formed a plurality of bulkheads 13 by which the interior of the crankcase 5 is divided into four aligned compartments which are respectively communicated with the cylinder bores 11. The above-mentioned bearing portions 7 are defined by the bulkheads 13 respectively.

As is seen from FIG. 11, the oil pan 4 is secured to a lower edge of the skirt portion 12 and formed at its front portion, namely, the portion near the cylinder #1, with a considerable recess 14 which serves as an oil sump.

As is understood from FIG. 12, the crankshaft 6 comprises generally five coaxially aligned journal portions 16 which are respectively held by the bearing portions 7, four crank pins 19 which are pivotally connected to respective pistons 17 through respective connecting rods 18, crank arms 20 which connect the crank pins 19 with the journal portions 16 and counterweights 21 which are integral with the crank arms 20.

Each counterweight 21 is integrally formed on the crank arm 20 at a diametrically opposed portion of the corresponding crank pin 19. The counterweight 21 has a sectoral configuration whose arcuate outer surface 21*a* is concentric with the axis of the crankshaft 6 and extends by about 120 degrees with respect to said axis.

As shown in FIG. 12, the crank pins 19 for the cylinders #1 and #4 are on the same side, while, the crank pins 19 for the cylinders #2 and #3 are on the opposed side.

As is seen from FIGS. 11 and 12, the cylinder block 1 is formed at a rear portion of one side wall (viz., skirt portion) thereof with a fresh air inlet passage 22. The passage 22 has an opening 22' which is exposed to the rearmost compartment in which the rearmost counterweight 21 for the cylinder #4 is received. More specifically, the opening 22' is so positioned as to face the arcuate outer surface 21*a* of the rearmost counterweight 21 when the latter is turned into a given angular zone. Similar to the aforementioned first, second and third embodiments, when the rearmost counterweight 21 is turned into the given angular zone, there is produced only a very thin clearance between the opening 22' and the arcuate outer surface 21*a* of the counterweight 21. Preferably, the clearance is about 3 to 4 mm in thickness.

It is to be noted that the fresh air passage 22 is formed in one of the opposed side walls of the skirt portion 12, the side wall being the wall which the arcuate outer surface 21*a* of the rearmost counterweight 21 approaches when the associated piston 17 (that is, the piston in the cylinder #4) moves downward. Thus, the passage 22 is formed in the "left" side wall of the cylinder block 1 when viewed from the front of the block 1 in FIG. 11.

As is seen from FIGS. 11 and 12, the cylinder block 1 is formed at a front portion of the other side wall (viz., skirt portion) thereof with a blow-by gas outlet passage 50. The passage 50 has an opening 50' which is exposed to the frontmost compartment in which the frontmost counterweight 21 for the cylinder #1 is received. More specifically, the opening 50' is so positioned as to face the arcuate outer surface 21*a* of the counterweight 21 when the latter is turned into a given angular zone. Similar to the above-mentioned fresh air passage 22, when the frontmost counterweight 21 is turned into the given angular zone, there is produced only a very thin clearance between the opening 50' and the arcuate outer surface 21*a* of the counterweight 21.

As is understood from FIG. 12, the blow-by gas outlet passage 50 is formed in the other side wall of the cylinder block 1, which is opposite to the wall in which the fresh air inlet passage 22 is formed. Thus, the passage 50 is formed in the "right" side wall of the cylinder block 1 when viewed from the front of the block 1 in FIG. 11.

Figure 13:
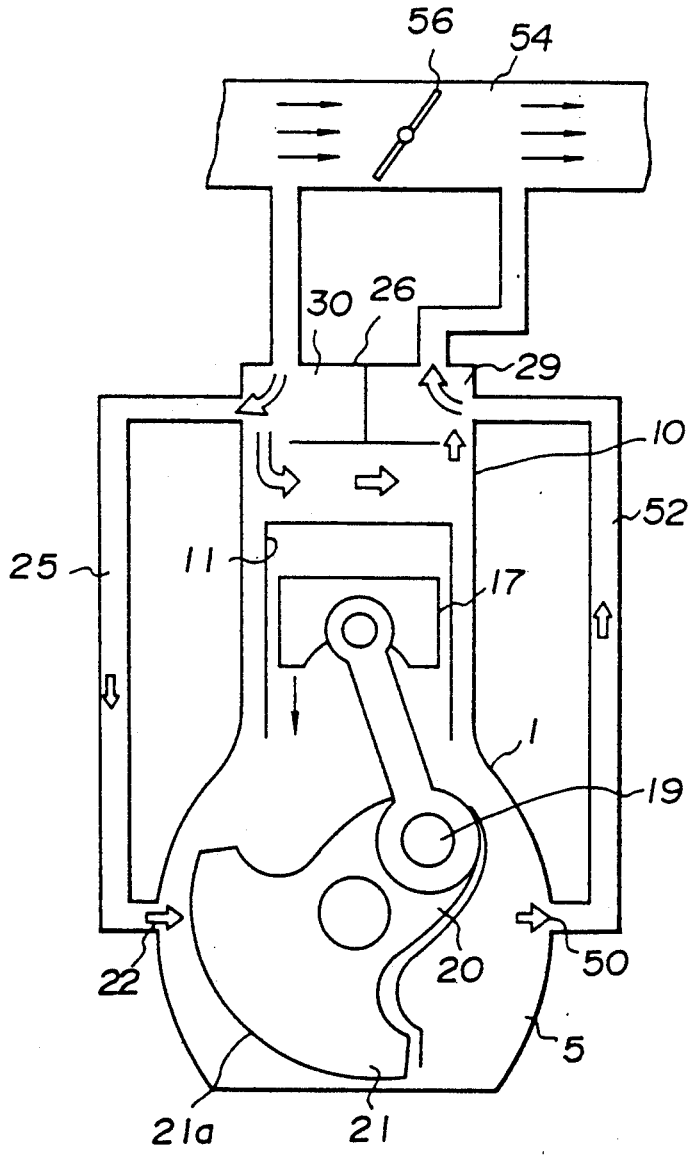
FIG. 13 is an illustration schematically showing the fifth embodiment.

As is schematically illustrated in FIG. 13, the fresh air inlet passage 22 is connected through a connecting tube 25 to a first oil separator 30, while, the blow-by gas outlet passage 50 is connected through another connecting tube 52 to a second oil separator 29. The first and second oil separators 30 and 29 are defined in a cylinder head cover 26 which is mounted on the cylinder head 10 on the cylinder block 1. The first oil separator 30 is connected through a tube (no numeral) to an air intake passage 54 of the engine at a position upstream of a throttle valve 56, while, the second oil separator 29 is connected through another tube (no numeral) to the air intake passage 54 at a position downstream of the throttle valve 56. As is shown by the arrows, within the cylinder head 10, there is defined a passage which connects the first and second oil separators 30 and 29. With this, ventilation in the cylinder head 10 is carried out in a manner as will be described hereinafter.

In the following, the operation of this embodiment will be described.

During operation of the engine, the four aligned compartments of the crankcase 5, which are defined by the bulkheads 13, are subjected to a considerable pressure fluctuation due to the reciprocating movements of the pistons 17. That is, when one piston 17 moves upward, the corresponding compartment is subjected to a pressure drop, while, when the piston 17 moves downward, the compartment is subjected to a pressure increase.

When thus the rearmost piston 17 in the cylinder #4 moves upward, the rearmost compartment to which the fresh air inlet passage 22 is exposed is subjected to a pressure drop and thus fresh air is driven into the crankcase 5 from the fresh air passage 22. In fact, during this time, the opening 22' of the passage 22 is not covered by the rearmost counterweight 21. When thereafter the piston 17 moves downward, the compartment is subjected to a pressure increase. However, during almost of this time, the opening 22' is covered by the counterweight 21, so that undesired back flow of fresh air in the passage 22 is suppressed or at least minimized. When the piston 17 for the cylinder #4 is under the downward movement, the pistons 17 for the cylinders #3 and #2 are under the upward movement. This induces a pressure difference in the crankcase 5, by which the fresh air is forced to flow toward the front of the interior of the crankcase 5.

That is, due to upward and downward movements of the pistons 17, a so-called "pumping effect" is created, so that the fresh air is forced fed into the crankcase 5.

Furthermore, when the piston 17 for the cylinder #4 moves downward causing the arcuate outer surface **21*a* of the rearmost counterweight 21 to pass by the opening 22' at high speed, there is produced a partial pressure drop at the opening 22'**, which promotes the pumping effect.

While, during the operation of the engine, the following operation takes place at the blow-by gas outlet passage 50.

That is, when the frontmost piston 17 in the cylinder #1 moves downward causing a pressure increase in the frontmost compartment to which the passage 50 is exposed, the opening 50' of the passage 50 is opened by the frontmost counterweight 21, while, when the piston 17 moves upward causing a pressure drop in the compartment, the opening 50' is closed or spacedly covered by the counterweight 21.

Thus, at the opening 50', a pumping effect is created, by which blow-by gas is driven from the crankcase 5 into the blow-by gas outlet passage 50.

Accordingly, the interior of the crankcase 5 can be effectively ventilated or scavenged.

In addition to this advantage, the fifth embodiment brings about the following additional advantages.

First, since the gas (viz., fresh air and blow-by gas) is forced to flow from the rear portion toward the front portion in the crankcase 5, oil in the oil pan 4 is urged to flow toward the oil sump 14. This advantage is equally possessed by the afore-mentioned first, second, third and fourth embodiments of the invention.

Second, since the arcuate outer surface **21*a* of the frontmost counterweight 21 approaches the opening 50' of the blow-by gas passage 50 while moving downward, the possibility in which oil splashed by the counterweight 21 is directed toward the opening 50' is small. Thus, undesired oil carrying out phenomenon through the blow-by gas passage 50** is minimized.

Figure 14:
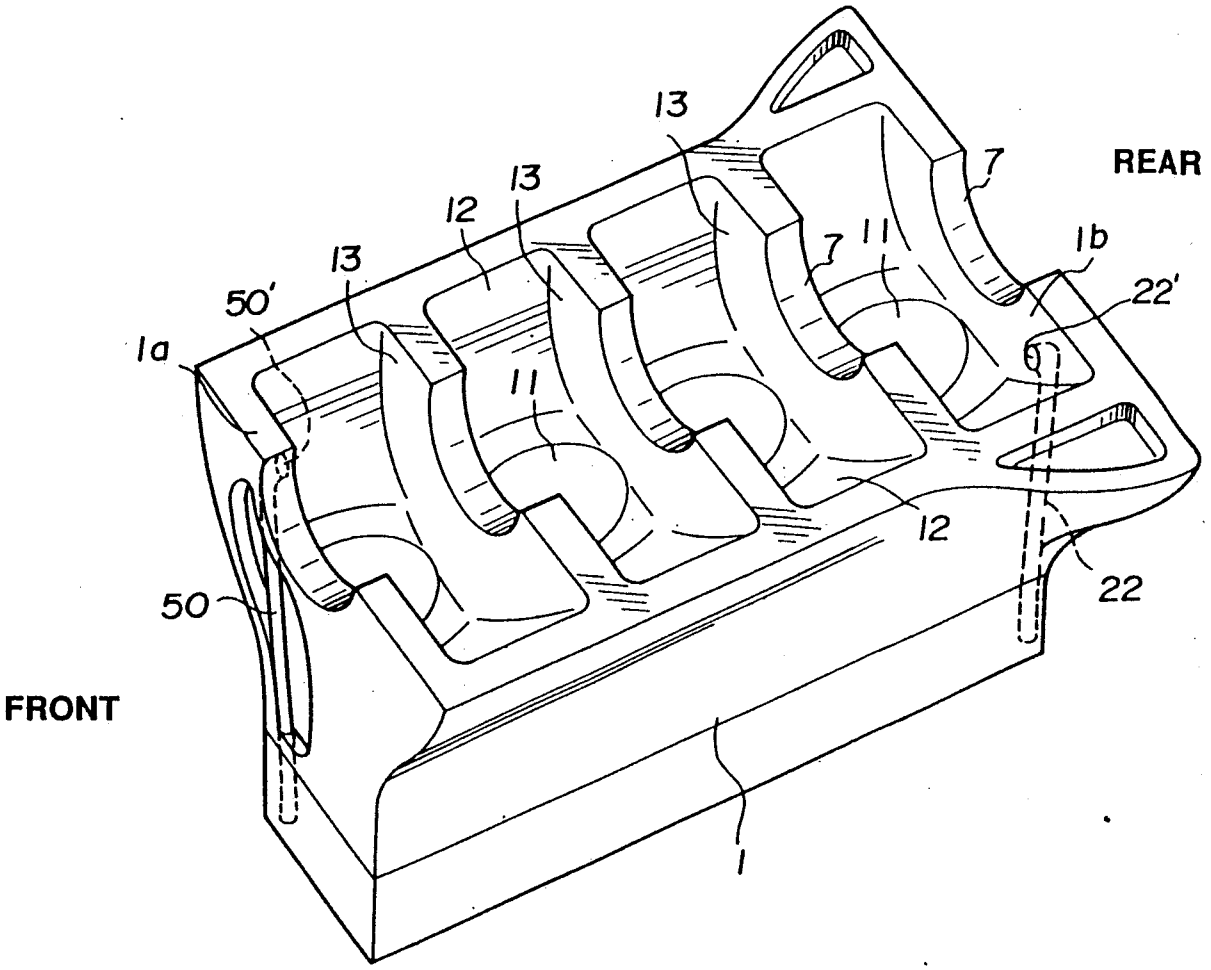
FIG. 14 is a perspective view of a cylinder head illustrated upside down, showing a sixth embodiment of the present invention.

Referring to FIG. 14, there is shown a sixth embodiment which is a modification of the above-mentioned fifth embodiment.

In this sixth embodiment, the cylinder block 1 is formed at its rear end wall **1*b* with a fresh air inlet passage 22. The passage 22 has an opening 22' which is exposed the rearmost compartment in which the rearmost counterweight 21 is located. More specifically, as shown in the drawing, the opening 22' is so positioned as to face a major outer surface 21*b* (see FIG. 12) of the counterweight 21 when the weight 21 is turned to an angular zone where the counterweight 21 screens or conceals the opening 22'. The cylinder block 1 is further formed at its front end wall 1*a* with a blow-by gas passage 50. The passage 50 has an opening 50' which is exposed to the frontmost compartment in which the frontmost counterweight 21 is located. Similar to the opening 22' of the fresh air passage 22, the opening 50' of the blow-by gas passage 50 is arranged to face a major outer surface of the frontmost counterweight 21. As is seen from the drawing, the two openings 22' and 50' are positioned oppositely with respect to the longitudinal axis of the cylinder block 1** for the reason which will be easily understood from the description of the fifth embodiment.

What is claimed is:

1. An internal combustion engine comprising:

a cylinder block and an oil pan which are assembled together to define a crankcase;

a crankshaft rotatably held in said crankcase and including a counterweight;

means for defining a fresh air inlet passage through which the interior of said crankcase and the outside of the engine are communicated said fresh air inlet passage having a fresh air inlet opening exposed to the interior of said crankcase at a position close to said counterweight so that, under rotation of said crankshaft, said fresh air inlet opening is periodically covered and opened by said counterweight;

means for defining a blow-by passage through which the interior of said crankcase and the outside of the engine are communicated;

means for producing in said crankcase a pressure fluctuation, said fluctuation cycling between a low and a high level during operation of the engine, and means for causing said fresh air inlet opening to be covered by said counterweight when the pressure in said crankcase is at said high level and opened by said counterweight when the pressure in said crankcase is at said low level.

2. An internal combustion engine as claimed in claim 1, in which said means for producing said pressure fluctuation comprises:

a compartment defined in said crankcase and receiving therein said counterweight; and a piston operatively disposed in a cylinder bore formed in said cylinder block, said cylinder bore being merged with said compartment, so that said compartment is subjected to a pressure fluctuation due to reciprocating movement of said piston in the cylinder bore.

3. An internal combustion engine as claimed in claim 2, in which said compartment is defined between neighboring bulkheads of said crankcase.

4. An internal combustion engine as claimed in claim 1, in which said counterweight is the rearmost one among a plurality of counterweights possessed by the crankshaft.

5. An internal combustion engine as claimed in claim 4, in which when the rearmost counterweight is turned into a given angular zone near said opening, there is produced, between the counterweight and said opening, a thin clearance of approximately 3 mm to 4 mm in thickness.

6. An internal combustion engine as claimed in claim 5, in which said blow-by gas passage includes a chain chamber of the engine, said chain chamber housing a cam chain of a valve operating mechanism of the engine.

7. An internal combustion engine as claimed in claim 5, in which said blow-by gas passage has another opening which is exposed to the interior of said crankcase at a position close to a frontmost counterweight of the crankshaft.

8. An internal combustion engine as claimed in claim 7, in which when said another opening is covered by said frontmost counterweight when the pressure in the crankcase is relatively decreased but opened by said frontmost counterweight when the pressure in the crankcase is relatively increased.

9. An internal combustion engine as claimed in claim 8, in which said opening and said another opening are formed at opposed wall positions of the cylinder block with respect to the rotation axis of said crankshaft.

10. An internal combustion engine as claimed in claim 4, in which said opening is so positioned as to face an arcuate outer surface of said counterweight when the counterweight is turned into a given angular zone.

11. An internal combustion engine as claimed in claim 10, in which said opening is elongated in a direction perpendicular to the rotation axis of said crankshaft, and in which the width of said opening is smaller than the thickness of the rearmost counterweight.

12. An internal combustion engine as claimed in claim 11, in which said opening is somewhat inclined with respect to said arcuate outer surface of the rearmost counterweight.

13. An internal combustion engine as claimed in claim 12, in which the clearance defined between said opening and said arcuate outer surface increases gradually with increase of distance from a leading peripheral part of the opening toward a trailing peripheral part of the same with respect to the direction in which said counterweight rotates under operation of the engine.

14. An internal combustion engine as claimed in claim 4, in which said opening is so positioned as to face a major surface of said counterweight when the counterweight is turned into a given angular zone.

15. An internal combustion engine as claimed in claim 4, in which said oil pan is formed with a depressed oil sump near a front end of said cylinder block.

16. An internal combustion engine as claimed in claim 1, further comprising:

a first passage connecting said fresh air passage to an air intake passage of the engine at a position upstream of a throttle valve; and a second passage connecting said blow-by gas passage to said air intake passage at a position downstream of said throttle valve.

17. An internal combustion engine as claimed in claim 16, further comprising first and second oil separators which are respectively disposed in said first and second passages.

18. An internal combustion engine as claimed in claim 17, in which said first and second oil separators are defined in a cylinder head cover of the engine.

19. An in-line four cylinder type internal combustion engine comprising:

a cylinder block and an oil pan which are assembled together to define a crankcase, said crankcase including a plurality of aligned compartments, each compartment being defined by neighbouring bulkheads and merged with a cylinder bore in which a piston is operatively disposed, so that the pressure in the compartment increases when the piston is moved toward its lower dead center and decreases when the piston is moved toward its upper dead center;

a crankshaft rotatably held in said crankcase and including a plurality of counterweights which are respectively received in said compartments;

means for defining in said cylinder block a fresh air inlet passage through which the interior of said crankcase and the outside of the engine are communicated, said air inlet passage having a fresh air inlet opening exposed to a terminal one of said compartments at a position close to a corresponding counterweight so that under rotation of the crankshaft, said fresh air inlet opening is periodically covered by said corresponding counterweight; and means for defining in said cylinder block a blow-by gas passage through which the interior of the crankcase and the outside of the engine are communicated, said blow-by gas passage having a blow-by gas opening exposed to the other terminal one of said compartments at a position close to a corresponding counterweight so that under rotation of the crankshaft, said blow-by gas opening is periodically covered by the corresponding counterweight;

wherein said fresh air inlet opening is covered by the corresponding counterweight when the pressure in the corresponding compartment increases, but opened by the same when the pressure in the corresponding compartment decreases; and wherein said blow-by gas opening is covered by the corresponding counterweight when the pressure in the corresponding compartment decreases, but opened by the same when the pressure in the corresponding compartment increases.

20. An in-line four cylinder type internal combustion engine as claimed in claim 19, in which said fresh air inlet opening and said blow-by gas opening are formed at opposed wall positions of said cylinder block with respect to the longitudinal axis of the crankcase.

21. An in-line four cylinder type internal combustion engine as claimed in claim 20, further comprising:

a first passage connecting said fresh air inlet passage to an air intake passage of the engine at a position upstream of a throttle valve;

a second passage connecting said blow-by gas passage to said air intake passage at a position downstream of the throttle valve;

a first oil separator disposed in said first passage; and a second oil separator disposed in said second passage, said first and second oil separators being defined in a cylinder head cover of the engine.

22. A V-8 type four cycle internal combustion engine, comprising:

a cylinder block having two angled banks;

an oil pan secured to a bottom of said cylinder block to define a crankcase, said crankcase including a plurality of aligned compartments, each compartment being defined by neighbouring bulkheads and merged with two angled cylinder bores in which respective pistons are operatively disposed, so that under operation of the engine, the compartment is subjected to a pressure fluctuation due to the reciprocating movements of the pistons;

a crankshaft rotatably held in said crankcase and including a plurality of counterweights which are respectively received in said compartments;

means for defining in said cylinder block a fresh air inlet passage through which the interior of said crankcase and the outside of the engine are communicated, said air inlet passage having a fresh air inlet opening exposed to a terminal one of said compartments at a position close to a corresponding counterweight so that under rotation of the crankshaft, said fresh air inlet opening is periodically covered by said corresponding counterweight; and means for defining in said cylinder block a blow-by gas passage through which the interior of the crankcase and the outside of the engine are communicated, said blow-by gas passage having a blow-by gas opening exposed to the other terminal one of said compartments at a position close to a corresponding counterweight so that under rotation of the crankshaft, said blow-by gas opening is periodically covered by the corresponding counterweight;

wherein said fresh air inlet opening is covered by the corresponding counterweight when the pressure in the corresponding compartment increases, but opened by the same when the pressure in the corresponding compartment decreases; and wherein said blow-by gas opening is covered by the corresponding counterweight when the pressure in the corresponding compartment decreases, but opened by the same when the pressure in the corresponding compartment increases.

23. A V-8 type four cycle internal combustion engine as claimed in claim 22, in which each compartment shows a higher pressure when a corresponding crank pin of the crankshaft assumes its lowermost position and a lower pressure when the corresponding crank pin assumes its uppermost position.

24. A V-8 type four cycle internal combustion engine as claimed in claim 23, in which said blow-by gas passage is defined by a chain chamber formed in said cylinder block, said chain chamber housing a cam chain of a valve operating mechanism of the engine.

25. A V-8 type four cycle internal combustion engine as claimed in claim 24, further comprising:

a first passage means connecting said fresh air inlet passage to an air intake passage of the engine at a position upstream of a throttle valve;

a second passage means connecting said blow-by gas passage to said air intake passage at a position downstream of the throttle valve;

a first oil separator means disposed in said first passage means; and a second oil separator means disposed in said second passage means, said first and second oil separator means being defined in each of cylinder head covers mounted on said two banks of the engine.

26. An internal combustion engine as claimed in claim 23, in which said fresh air inlet opening is covered by said counterweight for a given time which includes the time when the pressure in said compartment is at a maximum pressure occurring during said fluctuation cycle.

27. An internal combustion engine as claimed in claim 26, in which said fresh air inlet opening is kept covered by said counterweight for a given time which includes said time when said compartment shows the maximum pressure, a certain short time before said time and another certain short time after said time.

28. An internal combustion engine as claimed in claim 26, in which said fresh air inlet opening is kept covered by said counterweight for a given time during which the pressure in said compartment changes from the minimum degree to the maximum degree.

29. An internal combustion engine as claimed in claim 26, in which said counterweight has an asymmetric structure.

* * * * *